US009538631B2

(12) United States Patent
Ikeda et al.

(10) Patent No.: US 9,538,631 B2
(45) Date of Patent: Jan. 3, 2017

(54) ANTENNA STRUCTURE AND INTERNAL COMBUSTION ENGINE

(71) Applicant: IMAGINEERING, INC., Kobe (JP)

(72) Inventors: Yuji Ikeda, Kobe (JP); Ryoji Tsuruoka, Kobe (JP)

(73) Assignee: IMAGINEERING, INC., Kobe (JP)

( * ) Notice: Subject to any disclaimer, the term of this patent is extended or adjusted under 35 U.S.C. 154(b) by 85 days.

(21) Appl. No.: 14/578,758

(22) Filed: Dec. 22, 2014

(65) Prior Publication Data

US 2015/0181687 A1 Jun. 25, 2015

Related U.S. Application Data

(63) Continuation-in-part of application No. PCT/JP2013/066621, filed on Jun. 17, 2013.

(30) Foreign Application Priority Data

Jun. 22, 2012 (JP) ..... 2012-140552

(51) Int. Cl.

| | |
|---|---|
| ***H05H 1/46*** | (2006.01) |
| ***H01Q 1/40*** | (2006.01) |
| ***H01Q 9/30*** | (2006.01) |
| ***H01Q 1/32*** | (2006.01) |
| ***F02P 9/00*** | (2006.01) |
| ***F02P 23/04*** | (2006.01) |
| ***H05H 1/52*** | (2006.01) |
| *F02P 3/04* | (2006.01) |
| *F02P 7/03* | (2006.01) |
| *F02P 15/04* | (2006.01) |
| *F02P 15/08* | (2006.01) |

(52) U.S. Cl.

CPC ..... *H05H 1/46* (2013.01); *F02P 9/007* (2013.01); *F02P 23/045* (2013.01); *H01Q 1/3291* (2013.01); *H01Q 1/40* (2013.01); *H01Q 9/30* (2013.01); *H05H 1/52* (2013.01); *F02P 3/0407* (2013.01); *F02P 7/03* (2013.01); *F02P 15/04* (2013.01); *F02P 15/08* (2013.01); *H05H 2001/463* (2013.01)

(58) Field of Classification Search

CPC ..... H05H 1/46; H05H 1/52; H05H 2001/463; F02P 9/007; F02P 23/045; F02P 15/08; F02P 15/04; F02P 7/03; F02P 3/0407; H01Q 1/3291; H01Q 1/40; H01Q 9/30

USPC .... 123/144, 143 B, 143 R, 169 EL, 536–539

See application file for complete search history.

(56) References Cited

U.S. PATENT DOCUMENTS

| | | | | |
|---|---|---|---|---|
| 6,467,467 | B1 * | 10/2002 | Massholder | F02B 51/04 123/536 |
| 6,782,875 | B2 * | 8/2004 | Yoshimoto | F02B 51/06 123/536 |
| 8,602,005 | B2 * | 12/2013 | Ikeda | F02B 1/02 123/143 B |
| 2011/0030660 | A1 * | 2/2011 | Ikeda | F02B 1/02 123/536 |

* cited by examiner

*Primary Examiner* — Joseph Dallo
(74) *Attorney, Agent, or Firm* — Bacon & Thomas, PLLC

(57) ABSTRACT

The antenna structure has a high frequency wave transmission line that transmits a high frequency wave and an emission antenna part for emitting the high frequency wave supplied via the high frequency wave transmission line. The emission antenna part includes a metal antenna having a rod-like shape and a ceramic layer that covers at least a part of the metal antenna.

4 Claims, 8 Drawing Sheets

ANTENNA STRUCTURE AND INTERNAL COMBUSTION ENGINE

TECHNICAL FIELD

The present invention relates to an antenna structure and an internal combustion engine.

BACKGROUND

For a purpose of improvement in combustion efficiency and reduction in fuel consumption rate of an engine, there is developed an ignition device equipped with a high frequency wave antenna that creates a plasma generation region around a discharge electrode of an ignition plug (see Japanese Unexamined Patent Application, Publication No. 2007-113570). With this ignition device, air fuel mixture in the vicinity of the ignition plug is irradiated with a high frequency wave, thereby enabling improvement in combustion efficiency and reduction in fuel consumption rate. As an emission antenna for emitting the high frequency wave, a metal antenna is generally employed.

However, if the conventional metal antenna is used as the emission antenna of the high frequency wave, a problem is encountered that the metal antenna is insufficient in durability owing to severe wear and degradation. Furthermore, the conventional emission antenna is designed to supply the high frequency wave at a single point such as an ignition point and, therefore, is not capable of emitting the high frequency wave at an appropriate location and/or timing in accordance with flame propagation.

SUMMARY

The antenna structure of the present invention includes: a high frequency wave transmission line that transmits a high frequency wave; and an emission antenna part for emitting the high frequency wave supplied via the high frequency wave transmission line, wherein the emission antenna part is provided with a metal antenna having a rod-like shape and a ceramic layer that covers at least a part of the metal antenna.

In this antenna structure, at least apart of the metal antenna having the rod-like shape is covered with the ceramic layer, thereby enabling to relax localization of a created electric field. The conventional metal antenna creates an electric field locally at a tip end part of the antenna. On the other hand, the metal antenna covered with the ceramic layer creates an electric field all over a region covered with the ceramic layer, thereby making it possible to efficiently emit energy of the high frequency wave in accordance with a flowing flame. Furthermore, the metal antenna covered with the ceramic layer hardly wears or degrades.

The emission antenna part can have a brim part. The brim part can contribute to improve the directivity of the electric field, and makes it easy to achieve impedance matching.

An internal combustion engine of the present invention includes an ignition device; and the antenna structure as described above.

The emission antenna part of the antenna structure can be arranged in the vicinity of an ignition plug of the ignition device. By arranging the emission antenna part in the vicinity of the ignition plug, it becomes possible to irradiate a discharge electrode of the ignition plug with the high frequency wave at the same time of ignition, thereby improving ignition stability. Here, the aforesaid term "vicinity" is intended to mean a range in which a high frequency wave emitted from the emission antenna part can reach the ignition plug.

DETAILED DESCRIPTION

Figure 1:
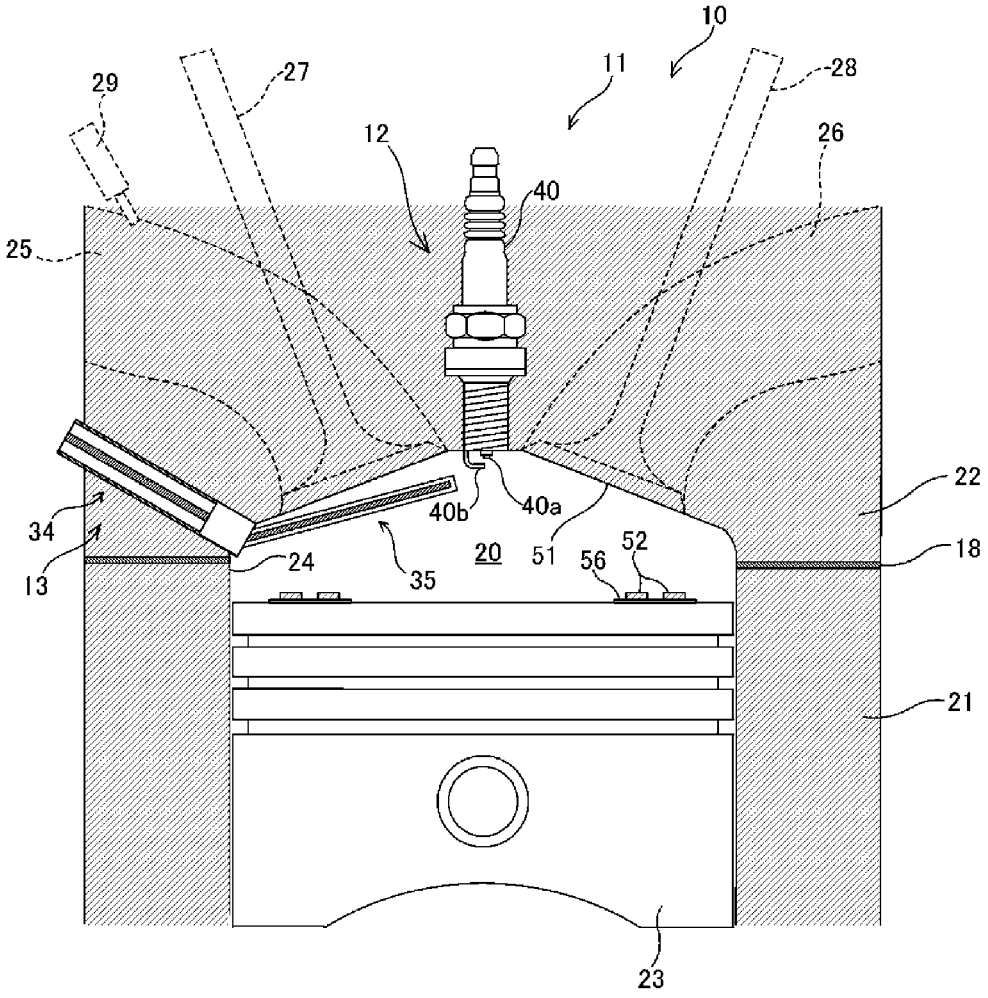
FIG. 1 is a vertical cross sectional view of an internal combustion engine according to an embodiment.

In the following, a detailed description will be given of an embodiment of the present invention with reference to the accompanying drawings. It should be noted that the following embodiments are merely preferable examples, and do not limit the scope of the present invention, applied field thereof, or application thereof.

The present embodiment is directed to an internal combustion engine 10 according to the present invention. The internal combustion engine 10 is a reciprocating internal combustion engine in which pistons 23 shown in FIG. 1 reciprocate. The internal combustion engine 10 includes an internal combustion engine main body 11, an ignition device 12, a high frequency wave emission device 13 including an antenna structure 34, and a control device (not shown). In the internal combustion engine 10, a combustion cycle in which an air fuel mixture is ignited by the ignition device 12 and combusted is repeatedly carried out.

Internal Combustion Engine Main Body

As shown in FIG. 1, the internal combustion engine main body 11 includes a cylinder block 21, a cylinder head 22, and pistons 23. The cylinder block 21 is formed with a plurality of cylinders 24 each having a circular cross section. In each cylinder 24, the piston 23 is reciprocatably mounted. The piston 23 is connected to a crankshaft (not shown) via a connecting rod (not shown). The crankshaft is rotatably supported by the cylinder block 21. While the piston 23 reciprocates in each cylinder 24 in an axial direction of the cylinder 24, the connecting rod converts the reciprocal movement of the piston 23 to rotational movement of the crankshaft.

The cylinder head 22 is placed on the cylinder block 21, and a gasket 18 intervenes between the cylinder block 21 and the cylinder head 22. The cylinder head 22 constitutes a partitioning member that partitions a combustion chamber 20 having a circular cross section along with the cylinder 24, the piston 23, and the gasket 18. A diameter of the combustion chamber 20 is, for example, approximately equal to a half wavelength of a high frequency wave emitted from the antenna structure 34 toward the combustion chamber 20.

Figure 2A:
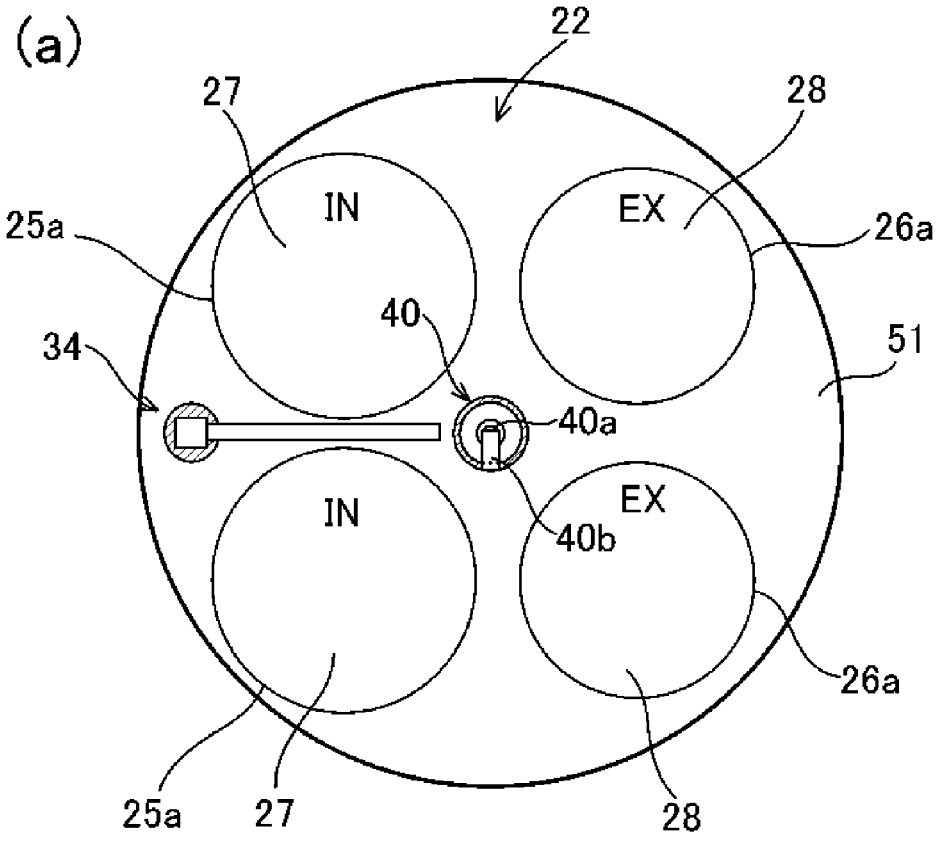
FIG. 2*a* is a front view of a ceiling surface of a combustion chamber of the internal combustion engine according to an embodiment.

In the cylinder head 22, one ignition plug 40 that constitutes a part of the ignition device 12 is provided for each cylinder 24. As shown in FIG. 2A, a tip end part of the ignition plug 40 is exposed toward the combustion chamber 20 and locates at a central part of a ceiling surface 51 of the combustion chamber 20. The ceiling surface 51 is a surface of the cylinder head 22 and exposed toward the combustion chamber 20. An outer periphery of the tip end part of the ignition plug 40 is circular viewed from an axial direction of the ignition plug 40. The ignition plug 40 is provided with a central electrode 40*a* and a ground electrode 40*b* at the tip end part of the ignition plug 40. A discharge gap is formed between a tip end of the central electrode 40*a* and a tip end of the ground electrode 40*b*.

The cylinder head 22 is formed with intake ports 25 and exhaust ports 26 for each cylinder 24. Each intake port 25 is provided with an intake valve 27 for opening and closing an intake side opening 25*a* of the intake port 25, and an injector 29 for injecting fuel. On the other hand, each exhaust port 26 is provided with an exhaust valve 28 for opening and closing an exhaust side opening 26*a* of the exhaust port 26.

Ignition Device

Figure 3:
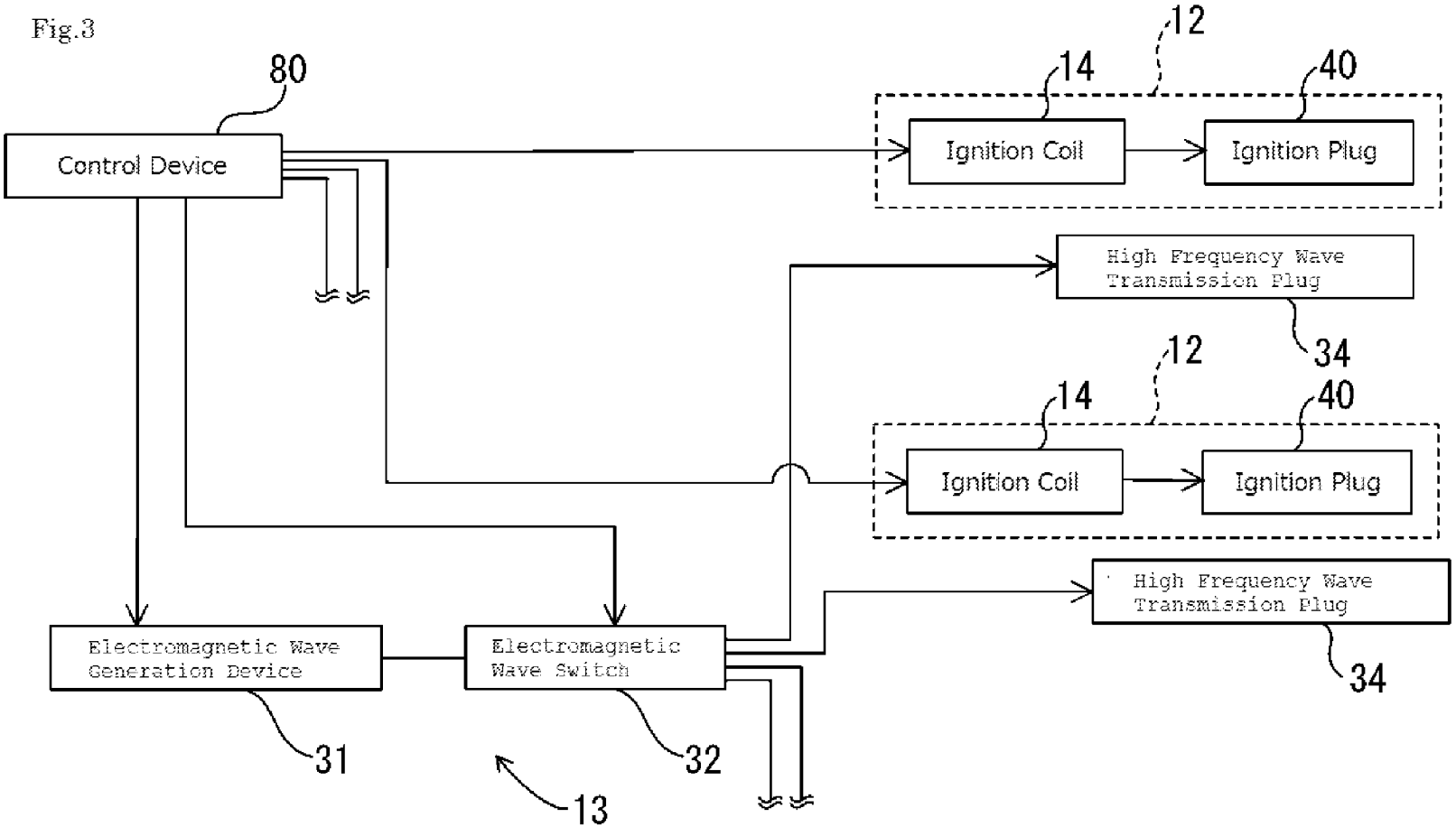
FIG. 3 is a block diagram of an ignition device and a high frequency wave emission device according to the embodiment.

The ignition device 12 is provided for each combustion chamber 20. As shown in FIG. 3, each ignition device 12 includes an ignition coil 14 that outputs a high voltage pulse, and the ignition plug 40 which the high voltage pulse outputted from the ignition coil 14 is supplied to.

The ignition coil 14 is connected to a direct current power supply (not shown). The ignition coil 14, upon receiving an ignition signal from a control device 80, boosts a voltage applied from the direct current power supply, and outputs the boosted high voltage pulse to the central electrode 40*a* of the ignition plug 40. The ignition plug 40, when the high voltage pulse is applied to the central electrode 40*a*, causes an insulation breakdown and a spark discharge to occur at the discharge gap. Along a discharge path of the spark discharge, discharge plasma is generated. The central electrode 40*a* is applied with a negative voltage as the high voltage pulse.

The ignition device 12, as a plasma enlarging part that enlarges the discharge plasma by supplying the discharge plasma with electric energy, enlarges the spark discharge by supplying the spark discharge with energy of a high frequency wave such as a microwave. By means of the plasma enlarging part, it is possible to improve ignition stability even with a lean air fuel mixture. The high frequency wave emission device 13, which will be described later, may be applied as the plasma enlarging part.

High Frequency Wave Emission Device

As shown in FIG. 3, the high frequency wave emission device 13 includes an electromagnetic wave generation device 31, an electromagnetic wave switch 32, and the antenna structure 34. One electromagnetic wave generation device 31 and one electromagnetic wave switch 32 are provided for the high frequency wave emission device 13, and the antenna structure 34 is provided for each combustion chamber 20.

The electromagnetic wave generation device 31, upon receiving an electromagnetic wave drive signal (a pulse signal) from the control device 80, continuously outputs a high frequency wave during a period of time of the pulse width of the electromagnetic wave drive signal. In the electromagnetic wave generation device 31, a semiconductor oscillator generates the high frequency wave in place of the semiconductor oscillator, any other oscillator such as a magnetron may be employed.

The electromagnetic wave switch 32 includes an input terminal and a plurality of output terminals provided for the respective antenna structures 34. The input terminal is electrically connected to the electromagnetic wave generation device 31. Each output terminal is electrically connected to an input terminal of the corresponding antenna structure 34. The electromagnetic wave switch 32 sequentially switches a supply destination of the high frequency wave outputted from the electromagnetic wave generation device 31 from among the plurality of the antenna structures 34 under a control of the control device 80.

Figure 4:
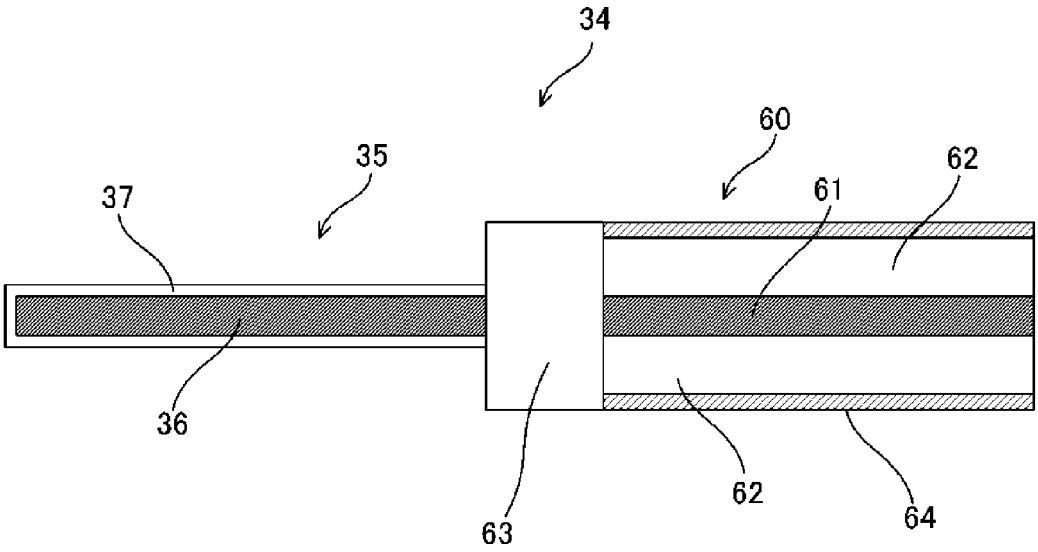
FIG. 4 is a vertical cross sectional view of an antenna structure according to the embodiment.

The antenna structure 34, as shown in FIG. 4, includes an emission antenna part 35 and a high frequency wave transmission line 60. The emission antenna part 35 is configured by a metal antenna 36 covered with a ceramic layer 37. The high frequency wave transmission line 60 includes a high frequency wave transmission conductor 61 that serves as a central conductor, an outer conductor 64, and an insulator 62 that fills between the high frequency wave transmission conductor 61 and the outer conductor 64. The emission antenna part 35 and the high frequency wave transmission line 60 are electrically connected with each other via a connector 63.

The metal antenna 36 has a rod-like shape. Here, the term "rod-like shape" is intended to include shapes of a pillar such as a column and a polygonal pillar, a plate, a stripe, and the like. Furthermore, the metal antenna 36 may have a curved structure, a partially bent structure, or the like, in accordance with a shape, an operating condition, and the like of the internal combustion engine 10, as long as the effect of the present invention is preserved. Furthermore, the metal antenna 36 may have protrusions and the like on surfaces thereof.

As material of the metal antenna 36, for example, tungsten, copper, silver, gold, aluminum, zinc, lead, tin, nickel, chrome, iron, cobalt, or the like may be employed, though there are no limitations as long as being electrically conductive. In view of excellent durability and high frequency wave transmission efficiency, tungsten and copper are preferable to the rest, and tungsten is preferable to copper.

The length of the metal antenna 36 is selectable as appropriate in accordance with the wavelength of the high frequency wave to be emitted, and preferably does not exceed a quarter wavelength of the high frequency wave. The diameter of the metal antenna 36 may be preferably 0.5 mm to 10 mm, and more preferably 1 mm to 3 mm.

The metal antenna 36 may be a part of the high frequency wave transmission conductor 61 which penetrates through the connector 63 and is exposed from the high frequency wave transmission line 60. This means that a part of a tip end of a conductor wire may be employed as the metal antenna 36, and the rest thereof may be employed as the high frequency wave transmission conductor 61.

As shown in FIG. 4, the ceramic layer 37 according to the present embodiment covers the whole surface of the metal antenna 36. In the case of a metal antenna without the ceramic layer 37, there is a tendency that a strong electric field is localized at a tip end part of the antenna. On the other hand, in a case of the metal antenna 36 covered with the ceramic layer 37 as described above, a strong electric field is created all over the outer peripheral surface of the antenna, and the high frequency wave is emitted therefrom. Accordingly, it is possible to efficiently emit energy of the high frequency wave in accordance with a flowing flame. In view of sufficient effect of relaxing the localization of the electric field, the thickness of the ceramic layer 37 covering the metal antenna 36 may be preferably within a range of 50 μm to 2 mm, and may be more preferably 100 μm to 1 mm.

The high frequency wave transmission conductor 61 is a linearly extending conductor. The high frequency wave transmission conductor 61 is disposed on an axial center of the insulator 62 over the whole length of the high frequency wave transmission line 60. On the other hand, the outer conductor 64 encloses the high frequency wave transmission conductor 61, and the insulator 62 intervenes between the high frequency wave transmission conductor 61 and the outer conductor 64. The outer conductor 64 is disposed spaced apart from the high frequency wave transmission conductor 61 at a constant distance over the whole length of the outer conductor 64. In the antenna structure 34, one end of the high frequency wave transmission line 60 serves as an input terminal of the high frequency wave. In the high frequency wave transmission line 60, the high frequency wave inputted from the input terminal is transmitted to the emission antenna part 35 without leaking to the outside of the outer conductor 64.

The antenna structure 34 is attached on a side of the intake port 25 of the cylinder head 22 so that the emission antenna part 35 is exposed toward the combustion chamber 20. The emission antenna part 35 is arranged along the ceiling surface of the combustion chamber 20 in a direction toward the ignition plug 40. The antenna structure 34 is threaded into a mounting hole on the cylinder head 22. In the antenna structure 34, the input terminal of the high frequency wave transmission line 60 is electrically connected to the output terminal of the electromagnetic wave switch 32 via a coaxial cable (not shown). In the antenna structure 34, when the high frequency wave is inputted from the input terminal of the high frequency wave transmission line 60, the high frequency wave passes through the high frequency wave transmission conductor 61 of the high frequency wave transmission line 60. The high frequency wave that has passed through the high frequency wave transmission line 60 is emitted from the emission antenna part 35 to the combustion chamber 20. According to the present embodiment, since the entire metal antenna 36 is covered with the ceramic layer 37, it is possible to emit the high frequency wave from the whole surface area of the emission antenna part 35.

In the internal combustion engine main body 11, the partitioning member that partitions the combustion chamber 20 is provided with a plurality of receiving antennae 52 that resonate with the high frequency wave emitted from the emission antenna part 35 to the combustion chamber 20. Each receiving antenna 52 is formed in a ring-like shape. As shown in FIG. 1, two receiving antennae 52 are provided on a top part of the piston 23. Each receiving antenna 52 is electrically insulated from the piston 23 by an insulation layer 56 formed on a top surface of the piston 23, and is provided in an electrically floating state.

Operation of Control Device

An operation of the control device 80 will be described hereinafter. The control device 80 performs a first operation of instructing the ignition device 12 to ignite the air fuel mixture and a second operation of instructing the high frequency wave emission device 13 to emit the high frequency wave after the ignition of the air fuel mixture, for each combustion chamber 20 during one combustion cycle.

More particularly, the control device 80 performs the first operation at an ignition timing at which the piston 23 locates immediately before the compression top dead center. The control device 80 outputs the ignition signal as the first operation.

The ignition device 12, upon receiving the ignition signal, causes the spark discharge to occur at the discharge gap of the ignition plug 40, as described above. The air fuel mixture is ignited by the spark discharge. When the air fuel mixture is ignited, the flame spreads from an ignition location of the air fuel mixture at a central part of the combustion chamber 20 toward a wall surface of the cylinder 24.

The control device 80 performs the second operation after the ignition of the air fuel mixture, for example, at a start timing of a latter half period of flame propagation. The control device 80 outputs the electromagnetic wave drive signal as the second operation.

The high frequency wave emission device 13, upon receiving the electromagnetic wave drive signal, causes the emission antenna part 35 to emit a continuous wave (CW) or a pulsed wave of the high frequency, as described above. The high frequency wave is emitted during the latter half period of the flame propagation. An output timing and a pulse width of the electromagnetic wave drive signal are configured such that the high frequency wave is emitted over a period in which the flame passes through a region where the two receiving antennae 52 are provided.

The high frequency wave resonates with each receiving antenna 52. In the vicinity of each receiving antenna 52, a strong electric field region having an electric field relatively strong in intensity in the combustion chamber 20 is formed all over the latter half period of the flame propagation. The flame, while passing through the strong electric field region, receives energy of the high frequency wave and accelerates its propagation speed.

In a case in which the high frequency wave energy is high, high frequency wave plasma is generated in the strong electric field region. In a region where the high frequency wave plasma is generated, active species such as OH radicals are generated. The propagation speed of the flame increases as the flame passes through the strong electric field region owing to the active species.

According to the present embodiment, in the emission antenna part 35, since the whole surface of the metal antenna 36 is covered with the ceramic layer 37, the localization of the electric field is relaxed, and the high frequency wave is emitted from anywhere on the surface area of the emission antenna part 35. Accordingly, the emission antenna part 35 can contribute to the improvement of ignition stability in the vicinity of the ignition plug 40, and promote the propagation speed of the flowing flame by efficiently emitting energy of the high frequency wave into the flame. As a result of this, it becomes possible to realize ultra-lean combustion and to reduce fuel consumption and CO2 emission.

Other Embodiments

Figure 5A:
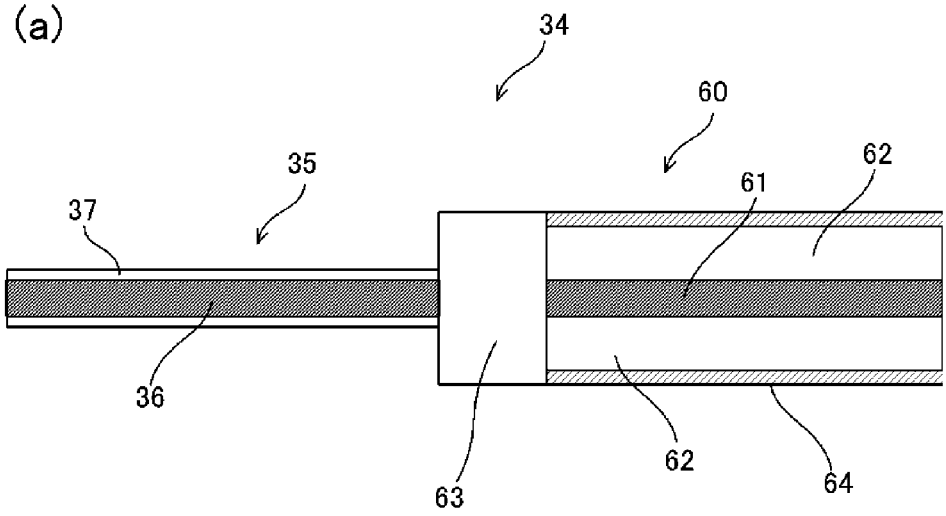
FIG. 5*a* is a vertical cross sectional view of an antenna structure according to another embodiment.

In the embodiment described above, as shown in FIG. 5A, the emission antenna part 35 may have a structure in which a tip end part of the metal antenna 36 is exposed, and the ceramic layer 37 covers only a side surface of the tip end part.

Figure 5B:
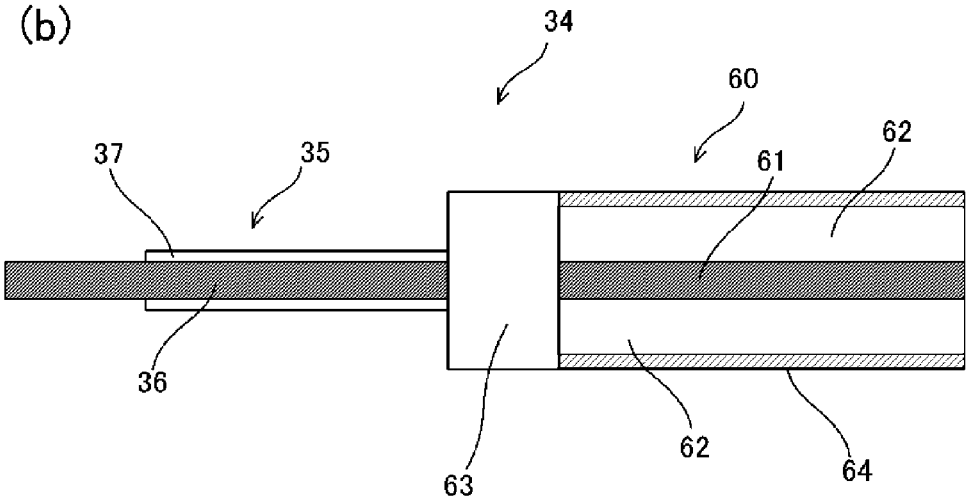
FIG. 5*b* is a vertical cross sectional view of an antenna structure according to another embodiment.

As shown in FIG. 5B, the emission antenna part 35 may have a structure in which a part on the tip end side of the metal antenna 36 is exposed, and the rest part on the side of the connector 63 of the metal antenna 36 is covered with the ceramic layer 37. The length of the exposed part of the metal antenna 36 is approximately equal to one third of the whole length of the metal antenna 36. The above-described structure enables enlargement of spark discharge by the ignition plug 40 at the tip end part of the metal antenna 36 and promotion of flame propagation at the part of the ceramic layer 37. The length of the exposed part of the metal antenna 36 is not limited to approximately one third of the whole length of the metal antenna 36, and may be changed as appropriate. The ceramic layer 37 on the emission antenna part 35 is not limited to the above-described shape, and may cover only a central part of the metal antenna 36 or discontinuously cover a plurality of locations.

Figure 5C:
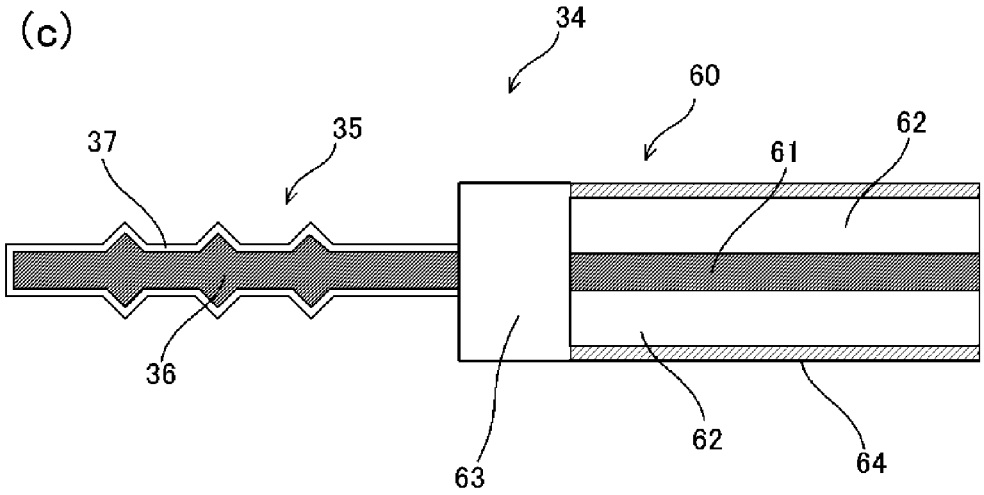
FIG. 5*c* is a vertical cross sectional view of an antenna structure according to another embodiment.

As shown in FIG. 5C, the emission antenna part 35 may have a structure in which the metal antenna 36 and the ceramic layer 37 has protrusions. The above-described structure makes it possible for the emission antenna part 35 to more finely control electric field intensity.

Figure 6A:
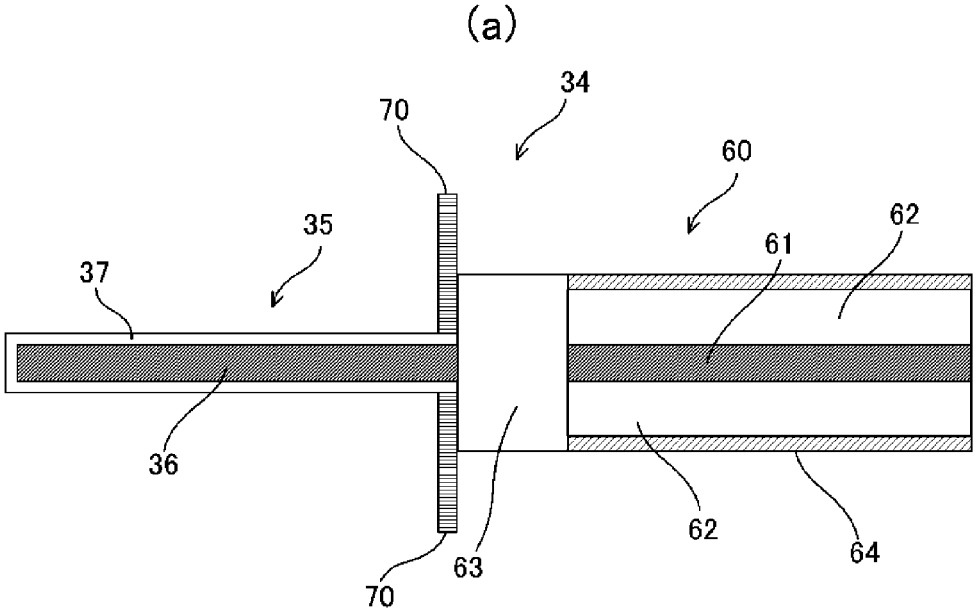
FIG. 6*a* is a vertical cross sectional view of an antenna structure according to a modified example of an embodiment.
Figure 6B:
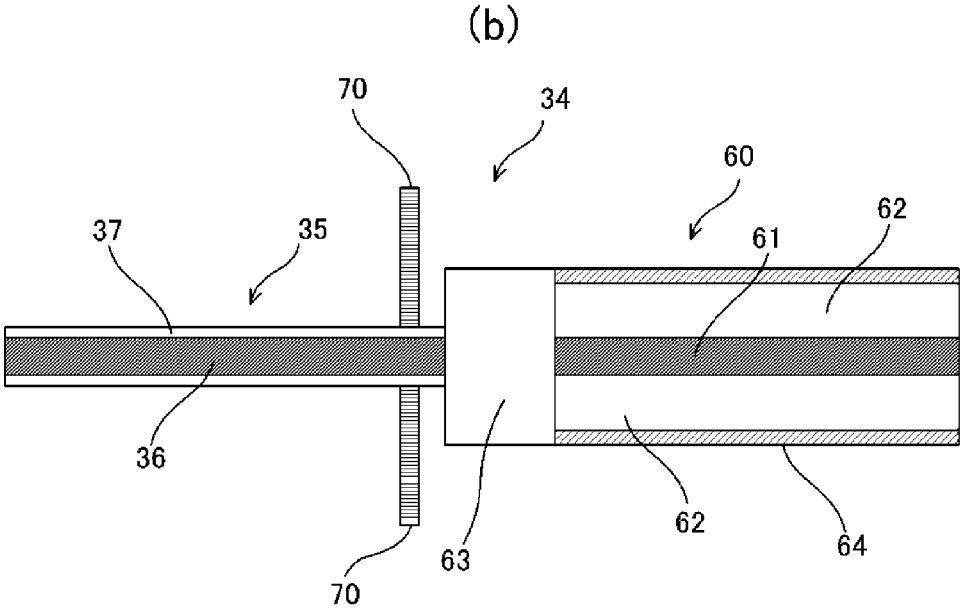
FIG. 6*b* is a vertical cross sectional view of an antenna structure according to a modified example of another embodiment.

As shown in FIGS. 6A to 6B, the emission antenna part 35 is preferably provided with a brim part 70. The antenna structure 34, in which the emission antenna part 35 is provided with the brim part 70, can improve the directivity of the electric field, and easily take impedance matching. It is preferable that the brim part 70 is constituted by a conductor through which high frequency wave will not permeate. As a result of this, it becomes possible to further improve the directivity of the electric field.

Figure 2B:
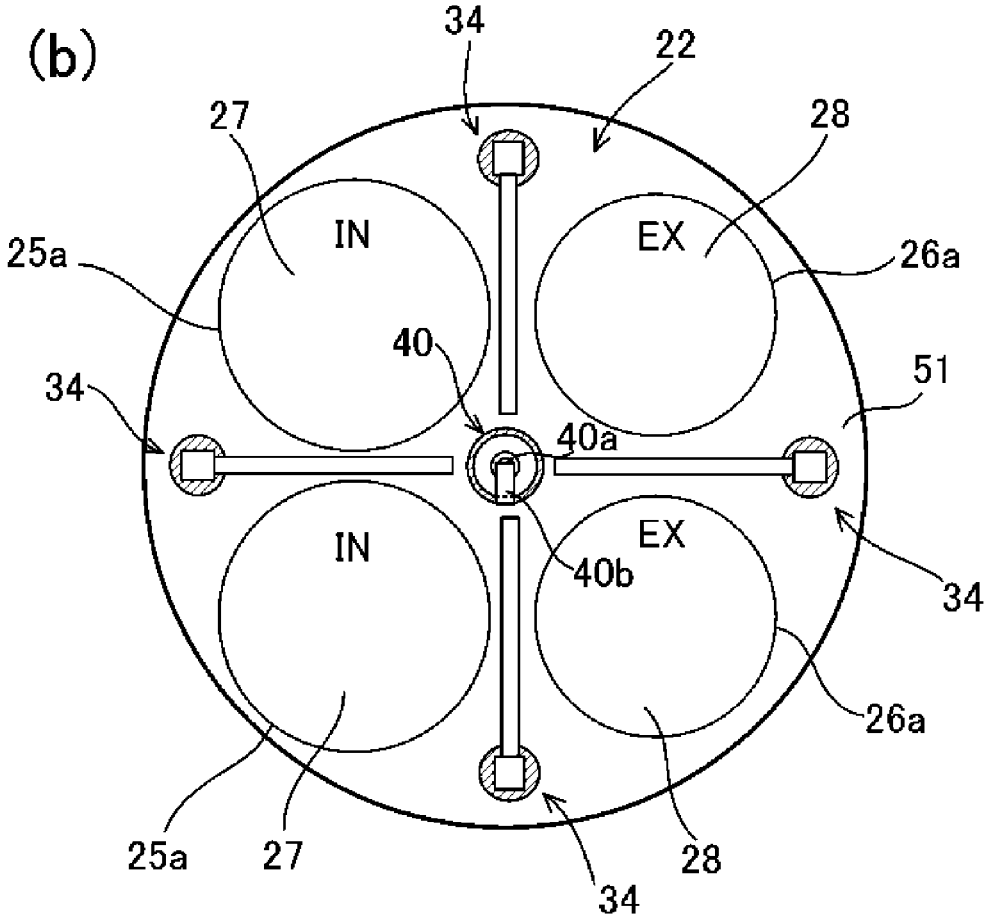
FIG. 2*b* is a front view of a ceiling surface of a combustion chamber of the internal combustion engine according to another embodiment.

In the embodiment described above, a plurality of the antenna structures 34 may be mounted in the internal combustion engine 10. For example, as shown in FIG. 2B, four antenna structures 34 may be radially arranged so that the tip end of each emission antenna part 35 should locate in the vicinity of the ignition plug 40. The above-described structure ensures more stable ignition with the ignition plug 40 and promote the flame propagation. Here, the four antenna structures 34 may be operated simultaneously, or may be controlled to emit the high frequency waves at different timings in accordance with respective conditions of the flame.

Furthermore, according to the embodiment described above, the high frequency wave transmission conductor 61 of the high frequency wave transmission line 60 maybe omitted, and a waveguide maybe employed as the high frequency wave transmission line 60.

Furthermore, according to the embodiment described above, the internal combustion engine 10 maybe of any other type such as a diesel engine, an ethanol engine, or a gas turbine. Furthermore, in a case in which the internal combustion engine 10 is applied as an aircraft engine, in the event of engine misfire, it is possible to generate high frequency wave plasma by enlarging the spark discharge plasma by way of the high frequency wave using the ignition device 12 and the high frequency wave emission device 13, thereby increasing stability of re-ignition.

What is claimed is:

1. An internal combustion engine comprising:

an ignition device disposed in a combustion chamber of the internal combustion engine; and at least one antenna structure disposed in the combustion chamber of the internal combustion engine and provided with a high frequency wave transmission line that transmits a high frequency wave and an emission antenna part for emitting the high frequency wave supplied via the high frequency wave transmission line;

wherein the emission antenna part is configured of a metal antenna having a rod-like shape and a ceramic layer that covers at least a part of the metal antenna; and wherein the emission antenna part is disposed so that a tip end of the emission antenna part is placed in the vicinity of the ignition device.

2. The internal combustion engine according to claim 1, wherein the ignition device comprises an ignition plug, and the emission antenna part of the antenna structure is arranged in the vicinity the ignition plug.

3. The internal combustion engine according to claim 1, wherein the emission antenna part of the antenna structure is arranged between intake valves and/or between exhaust valves.

4. The internal combustion engine according to claim 1, wherein the emission antenna part is provided with a brim part.

* * * * *